United States Patent [19]
Lombardi
[11] 4,290,583
[45] Sep. 22, 1981

[54] CLAW HAMMER WITH IMPROVED FULCRUM

[76] Inventor: Michael Lombardi, 556 Princeton Ave., Bricktown, N.J. 08723

[21] Appl. No.: 174,717

[22] Filed: Aug. 1, 1980

[51] Int. Cl.[3] ..... B25C 11/00
[52] U.S. Cl. ..... 254/26 R; 145/29 R
[58] Field of Search ..... 145/29 R; 254/26 R, 254/26 E, 27

[56] References Cited

U.S. PATENT DOCUMENTS

| | | | |
|---|---|---|---|
| D. 32,402 | 3/1900 | Whitford | 254/26 R |
| 140,821 | 4/1845 | MacWithey | 254/26 R |
| 752,879 | 2/1904 | Ashland | 254/26 R |
| 785,921 | 3/1905 | Springer | 254/26 R |
| 1,286,335 | 12/1918 | Johnson | 254/26 R |
| 1,957,760 | 5/1934 | Cownie | 254/26 R |

FOREIGN PATENT DOCUMENTS

| | | | |
|---|---|---|---|
| 505553 | 9/1954 | Canada | 254/26 R |
| 117273 | 7/1918 | United Kingdom | 254/26 R |

*Primary Examiner*—Stephen G. Kunin
*Assistant Examiner*—J. T. Zatarga
*Attorney, Agent, or Firm*—Martin Sachs

[57] ABSTRACT

A claw hammer is provided with a wedge-shaped portion on the contact surface between the anvil portion and the clawed portion in order to enable the user thereof to remove nails from a surface with a minimum of effort and a reduced swing of the handle.

5 Claims, 3 Drawing Figures

CLAW HAMMER WITH IMPROVED FULCRUM

BACKGROUND OF THE INVENTION

1. Field of the Invention

The present invention relates to hammers and, in particular, to a claw hammer provided with an improved fulcrum point on the contact surface of the hammer head to reduce the effort required in removing nails.

2. Discussion of the Relevant Art

The art abounds with modifications to conventional claw hammer heads in order to aid the carpenter in removing nails which, for some reason, are retained within a wood surface and have been driven in improperly or have struck a knot and cannot be driven completely therein. This type of problem occurs frequently and the carpenter is obliged to waste inordinate amounts of time to remove the nail from the wood and replace it with another nail. Many devices have been suggested for use to increase the speed of removing these unwanted nails. For example, U.S. Pat. No. 2,747,835 issued to T. M. Belgard on May 29, 1956, provided a resilient fulcrum which was affixed to the hammer head of a conventional claw hammer. The fulcrum thus provided helped the carpenter in removing nails. However, the increased height of the hammer head prevented the carpenter from nailing as close to the surface as he would normally be required to do. Furthermore, utilizing a device to clamp the revised fulcrum to the hammer head is unreliable because the continual use of the hammer in driving nails causes extreme shock and vibration to the attached device thereby loosening the fit and causing it, after continual use for a period of time, to work loose and possibly cause injury if it flies off the hammer head.

Other devices utilized to accomplish the same end included mechanisms which were inserted into the hammer head in manufacture and required a plurality of pieces to be assembled. Such a device is disclosed in U.S. Pat. No. 736,797 issued to G. J. Steele on Aug. 18, 1903. Although the device appears to be rather simple, in actual use the continual driving in of nails causes the auxiliary fulcrum to lose its gripping effect with use and may dislodge from the hammer head causing possible injury. Here again, if the auxiliary fulcrum is allowed to remain fully extended, it does not permit the carpenter to place a nail as close to the wall as he may be required to do.

Therefore, it is an object of the present invention to provide a simple device to improve the ability of a claw hammer to remove long nails from a surface.

It is another object of the present invention to provide a claw hammer with a fulcrum which minimally effects the ability of the user thereof to place nails proximate to a perpendicular surface.

It is yet another object of the present invention to provide a claw hammer with an improved fulcrum for removing nails which will not loosen or fall off during constant use of the hammer.

It is yet another object of the present invention to provide a claw hammer that is simple to manufacture and contains a minimum of parts while providing an improved fulcrum point.

SUMMARY OF THE INVENTION

The present invention overcomes the shortcomings found in the prior art by providing a simple, inexpensive means of modifying a conventional claw hammer so that a carpenter may readily remove long nails from a surface while permitting nails to be driven proximate a vertical or abutting surface.

A claw hammer, according to the principles of the present invention, comprises, in combination; an elongated handle having a longitudinal axis adapted to receive a hammer head on one end thereof. The hammer head is provided with an opening adapted to receive and cooperate with the handle retaining the handle therein. The hammer head is provided with a clawed portion extending forward of the handle longitudinal axis and an anvil portion which extends rearward of the handle longitudinal axis. The contact surface of the hammer head between the clawed portion and the anvil portion is provided with an outwardly wedge-shaped extending portion providing a fulcrum point proximate the longitudinal axis of the handle when the clawed portion is utilized for extracting nails from a surface.

The subject matter which I regard as my invention is particularly pointed out and distinctly claimed in the concluding portion of the specification. My invention, itself, however both as to its organization and method of operation, together with further objects and advantages thereof may best be understood by reference to the following description taken in connection with the accompanying drawing.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENT

Figure 1:
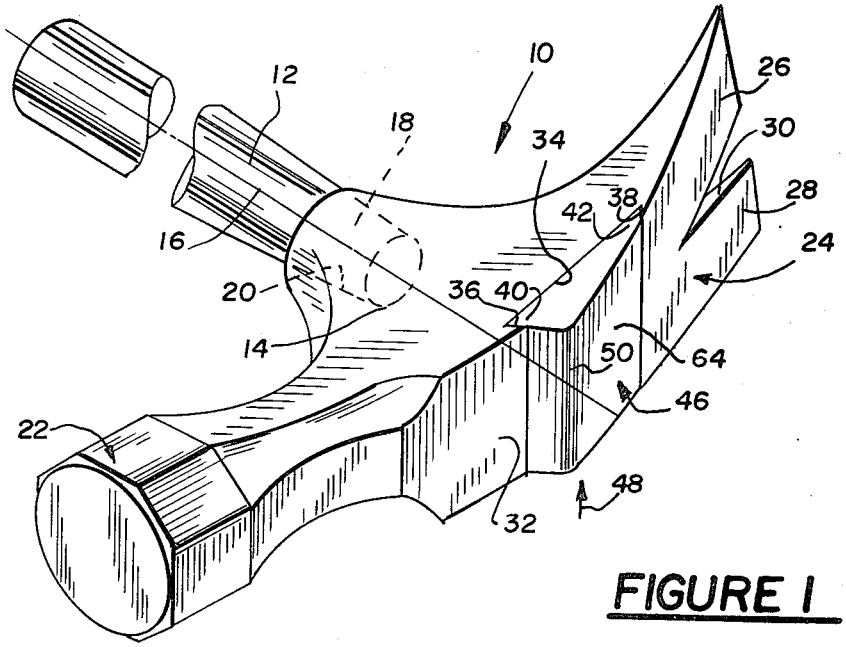
FIG. 1 is an isometric view of a claw hammer having an improved fulcrum according to the principles of the present invention.

Referring now to the figures, and in particular to FIG. 1, an isometric view of a claw hammer 10 lying on its side is shown. The hammer 10 is seen to include a handle 12 and a hammer head 14. The handle 12 is a conventional, elongated handle having a longitudinal axis 16 and is provided with a tapered end 18 adapted to be received into an opening 20 provided in the hammer head 14. The handle 12 may be fabricated of wood, metal, metal having a coating of leather or rubber as is presently known in the art.

The hammer head 14 has an anvil portion 22 which is used in a conventional manner, for driving nails for other objects into wood and a clawed portion 24 generally used to remove nails or other objects which have been improperly driven into a wooden surface. As a point of reference, it will be considered that the clawed portion 24 extends in a forwardly direction and the anvil portion 22 extends in a rearwardly direction relative to the longitudinal axis 16 of the handle.

The clawed portion 24 of the hammer head 14 is seen to include two claws 26 and 28 separated by a V-shaped slot 30 which is adapted to receive a nail, not shown, therein when being removed from a surface. Claws 26 and 28 are seen to slope toward the handle 12 and form a smooth curve generally at an angle of about 30° from the contact surface 32, that is the surface that comes into contact with the surface that the nail has been driven into when in use, of the hammer head 14. Earlier types of clawed hammers utilized a more curved clawed portion in order to obtain the extra leverage necessary to remove a stubborn nail that had been driven into wood. However, utilizing this type of configuration required that the hammer handle 12 be rotated through a comparatively large arc. With the configuration of the instant invention, the arc required to remove a nail is much reduced as is more clearly shown with reference to FIG. 3.

Figure 2:
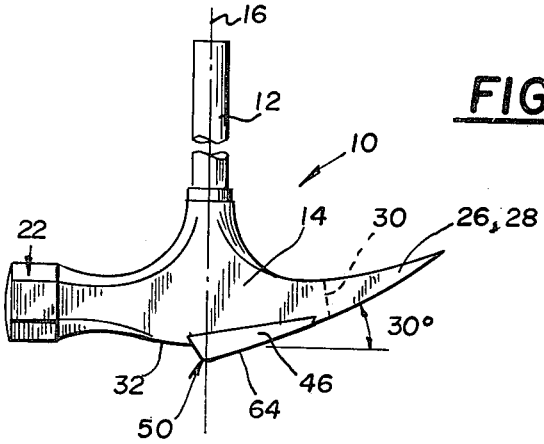
FIG. 2 is a side view in elevation of the claw hammer in FIG. 1.

The surface 32 of hammer head 14 is provided with a transverse groove or slot 34 which has two undercut side walls 36 and 38 forming which is commonly referred to as a "dove tail". A mating protrusion 40 and 42 is provided on wedge-shaped extending portion 46 so that the wedge-shaped portion may be inserted into the groove or slot 34 by moving it in a transverse direction as shown by arrow 48 and held in position by friction. The wedge-shaped extending portion is provided with a fulcrum point 50 about which the hammer head will rotate when the hammer is used to remove nails from a surface. The fulcrum point 50, which is effectively a transverse line, in the embodiment shown in FIGS. 1 and 2 occurs in line with the longitudinal axis 16 of the hammer 12 and is more clearly apparent when referring to FIG. 2.

It is to be noted that although the wedge-shaped extending portion 46 is shown to be separate and apart from the hammer head 14 it may also be manufactured as an integral part of the hammer head 14 with the shape and characteristics as described herein. There are advantages in having the wedge-shaped extending portion removable, such as for example, if it should become worn or damaged it may be replaced. The unitary construction of a hammer head 14 with the wedge-shaped extending portion is shown in FIG. 3.

Figure 3:
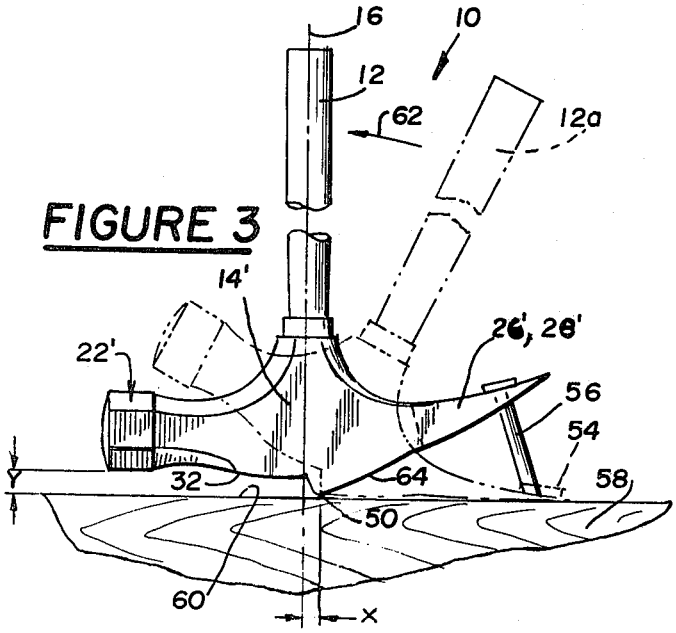
FIG. 3 is a side view in elevation of an alternative embodiment of the claw hammer showing the removal of a nail from a surface therewith.

An alternative embodiment is shown in FIG. 3 wherein the hammer head 14' includes an anvil portion 22' and claw portions 24 and 26 which are identical to the portions described earlier with regard to FIGS. 1 and 2. However, the wedge-shaped portion 46 has been integrally formed with the hammer head 14' in the embodiment shown in FIG. 3 and the fulcrum point 50' is displaced from the longitudinal axis 16 of the handle 12 by a distance X not to exceed $\frac{1}{4}$ inch (0.635 cm). In both embodiments of the present invention, the height of the fulcrum point 50 is preferably maintained no more than $\frac{3}{8}$ of an inch (0.953 cm) above the surface 32 of the hammer head 14 or 14'.

FIG. 3 discloses the operation of the hammer 10 with the improved fulcrum point. As shown in dotted lines the hammer engages the head 54 of a nail 56 which has been driven into a wooden surface 60. As the hammer handle **12*a* is rotated in the direction of arrow 62 the fulcrum point 50 is in contact with the wood surface 60 thereby permitting the claws 24' and 26' to raise the nail 56 entrapped in slot 30 out of the wood 58**. As shown, the movement of the hammer handle through an arc is reduced over other claw hammers presently known in the art.

Preferably the rise 64 of the wedge-shaped portion 46 is made essentially tangent with the arcuate curve of the claws 26 and 28 so that a user of the hammer may permit the hammer to stand upright, inverted on a flat surface. This enables the user thereof to have the hammer readily available to him each time it is placed on a surface while he performs another function, such as retrieving additional nails to be driven in.

Hereinbefore has been disclosed an improved claw hammer which has a minimum of components and is inexpensive to manufacture yet includes a number of advantages over those known in the present state of the art. Various changes in the details, materials, arrangement of parts and operating conditions which have been herein described and illustrated in order to explain the nature of the invention may be made by those skilled in the art within the principles and scope of the present invention.

Having thus set forth the nature of the invention, what is claimed is:

1. A claw hammer comprising, in combination:

(a) an elongated handle having a longitudinal axis and adapted to receive a hammer head on one end thereof; and (b) a hammer head having an opening provided therein adapted to receive and cooperate with said handle retaining said handle therein, said hammer being provided with a clawed portion extending forward of said handle longitudinal axis at an angle of between 0° and 30° from the contact surface thereof and an anvil portion extending rearward of said handle longitudinal axis, the contact surface of said hammer head between said clawed portion and said anvil portion being provided with an outwardly wedge-shaped extending portion providing a fulcrum point proximate the longitudinal axis of said handle when said clawed portion is utilized for extracting nails from a surface, the rise of said wedge-shaped extending portion being generally tangent with the surface of said clawed portion for providing a generally flat surface enabling said claw hammer to stand head down on a flat surface.

2. A claw hammer according to claim 1 wherein said fulcrum point is in line with said handle longitudinal axis.

3. A claw hammer according to claim 1 wherein said fulcrum point is disposed between said longitudinal axis and no greater than substantially $\frac{1}{4}$ of an inch (0.635 cm) forward from said longitudinal axis.

4. A claw hammer according to claim 1 wherein said fulcrum point is between 0.1 inches (0.254 cm) and no greater than substantially $\frac{3}{8}$ of an inch 0.953 cm above said surface of said hammer head.

5. A claw hammer according to claims 1, 2, 3, or 4 wherein said surface of said hammer head is provided with a transverse dovetailed groove between said anvil and said clawed portions and said wedge-shaped extending portion is provided with protrusions adapted to mate and cooperate with said dovetailed groove for retaining said wedge-shaped portion therein.

* * * * *